US011414800B2

(12) United States Patent
Ishikawa

(10) Patent No.: US 11,414,800 B2
(45) Date of Patent: Aug. 16, 2022

(54) SEWING MACHINE

(71) Applicant: JANOME SEWING MACHINE CO., LTD., Tokyo (JP)

(72) Inventor: Muneyuki Ishikawa, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 51 days.

(21) Appl. No.: 16/995,884

(22) Filed: Aug. 18, 2020

(65) Prior Publication Data

US 2021/0079575 A1 Mar. 18, 2021

(30) Foreign Application Priority Data

Sep. 17, 2019 (JP) ..... JP2019-167931

(51) Int. Cl.
*D05B 87/02* (2006.01)
*D05B 49/00* (2006.01)

(52) U.S. Cl.
CPC ..... *D05B 87/02* (2013.01); *D05B 49/00* (2013.01)

(58) Field of Classification Search
CPC ..... D05B 87/00; D05B 87/02; D05B 87/04; D05B 49/00; D05B 29/02
See application file for complete search history.

(56) References Cited

U.S. PATENT DOCUMENTS 5,086,719 A * 2/1992 Ogawa ..... D05B 87/02 112/221
5,092,257 A * 3/1992 Ogawa ..... D05B 87/02 112/225
7,143,706 B2 12/2006 Fujihara et al.
2004/0099190 A1* 5/2004 Kitazawa ..... D05B 87/02 112/225
2006/0011121 A1 1/2006 Fujihara et al.
2007/0204776 A1* 9/2007 Wacker ..... D05B 87/02 112/225

FOREIGN PATENT DOCUMENTS

JP 2006-14835 A 1/2006

* cited by examiner

*Primary Examiner* — Nathan E Durham
(74) *Attorney, Agent, or Firm* — Nakanishi IP Associates, LLC

(57) ABSTRACT

In a sewing machine, an elevating unit is configured to be integrally raised and lowered with a threading lever of a threading apparatus. Furthermore, an operating lever is coupled to a lever interlocking mechanism that interlocks with the rotational operation of the operating lever. Upon pressing threading lever downward from an initial position when operating lever is at an operating position, an elevating unit engages with lever interlocking mechanism. Operating force applied to threading lever is transmitted to operating lever via lever interlocking mechanism, thereby turning operating lever from operating position to non-operating position. Accordingly, even when a presser is at a raised position, by pressing threading lever downward, operating lever is turnable from operating position to non-operating position, thereby allowing presser to return to pressing position.

6 Claims, 6 Drawing Sheets

SEWING MACHINE

CROSS REFERENCE TO RELATED APPLICATION

This application claims priority to Japanese Patent Application No. 2019-167931 filed on Sep. 17, 2019, the entire content of which is incorporated by reference.

BACKGROUND OF THE INVENTION

1. Field of the Invention

The present invention relates to a sewing machine.

2. Description of the Related Art

Conventional sewing machines are known having a threading apparatus configured to allow a thread to be inserted into a needle hole of a needle. With such a threading apparatus, upon pressing a threading lever downward, the threading apparatus is lowered, and the threading apparatus performs a threading operation. Furthermore, with such a sewing machine, upon operating an operating lever, a presser is raised from a pressing position. With this arrangement, upon operating the threading apparatus in a state in which the presser is arranged at a position raised from the pressing position, in some cases, this involves interference between the threading apparatus and the presser. Accordingly, in order to prevent the occurrence of such interference between the threading apparatus and the presser, the threading apparatus performs the threading operation in a state in which the presser is arranged at the pressing position. That is to say, when the presser is arranged at a position raised from the pressing position, the user is required to operate the operating lever so as to displace the presser to the pressing position before the threading apparatus is operated.

In contrast, with the sewing machine described in Patent document 1 listed below, upon operating a threading operating unit in order to operate the threading mechanism, the presser is raised or lowered to a position so as to avoid interference between the presser and a threading hook of the threading mechanism. This allows the threading operation to be performed in a state in which the presser is arranged at the pressing position. This provides improved operating efficiency for the user.

RELATED ART DOCUMENTS

Patent Documents

[Patent document 1]
Japanese Patent Application Laid Open No. 2006-14835

SUMMARY OF THE INVENTION

Disclosure of the Invention

Problem to be Solved by the Invention

However, the sewing machine disclosed in Patent document 1 has a configuration for displacing the presser position by the driving operation of the motor. This involves a problem of an increase in the cost of the sewing machine.

Giving consideration to the above-described facts, it is a purpose of the present invention to provide a sewing machine that provides improved operating efficiency while suppressing an increase in cost.

Means to Solve the Problem

At least one embodiment of the present invention proposes a sewing machine including: a threading apparatus including a threading lever configured to be operated manually, and structured such that, upon pressing the threading lever downward from an initial position, a thread is inserted into a needle hole of a needle; an elevating unit configured to be raised and lowered together with the threading lever; an operating lever structured such that, upon operating the operating lever from a non-operating position to an operating position, a presser is raised from a pressing position; and a lever interlocking mechanism configured to interlock with the operation of the operating lever. When the operating lever is set to the operating position, and when the elevating unit is lowered, the elevating unit is engaged with the lever interlocking mechanism, and the operating force applied to the threading lever is transmitted to the operating lever via the lever interlocking mechanism, which moves the operating lever from the operating position to the non-operating position.

At least one embodiment of the present invention also proposes the sewing machine. When the operating lever is operated, the lever interlocking mechanism is not engaged with the elevating unit when the threading lever is set to the initial position.

At least one embodiment of the present invention also proposes the sewing machine. The threading apparatus includes a threading mechanism unit configured to perform a thread insertion operation in which the thread is inserted into the needle hole. Upon pressing the threading lever downward, the threading lever is lowered from an initial position to a second pressed-down position via a first pressed-down position. Before the threading lever reaches the first pressed-down position, the operating lever is moved to the non-operating position by the lever interlocking mechanism when the operating lever is set to the operating position, and engagement between the lever interlocking mechanism and the elevating unit is released. When the threading lever is lowered from the first pressed-down position to the second pressed-down position, the threading mechanism unit performs the thread insertion operation.

At least one embodiment of the present invention also proposes the sewing machine. A gear portion is formed in the operating lever. The lever interlocking mechanism is configured as a gear train coupled to the gear portion.

At least one embodiment of the present invention also proposes the sewing machine. An operating shaft is provided to the elevating unit. The gear train includes a coupling gear including an engagement portion that allows the gear train to be engaged with the operating shaft. When the threading lever is set to the initial position and the operating lever is set to the operating position, the engagement portion is arranged on a path of the operating shaft and below the operating shaft with a gap between them. When the operating lever is set to the non-operating position, the engagement portion is arranged at a position displaced from the path of the operating shaft.

At least one embodiment of the present invention also proposes the sewing machine. An engagement groove is provided to the coupling gear. After the operating shaft is engaged with the engagement portion, the operating shaft is inserted into the engagement groove.

Advantage of the Present Invention

With the sewing machine having the above-described configuration, such a sewing machine provides improved operation efficiency while suppressing an increase in costs.

BRIEF DESCRIPTION OF THE DRAWINGS

FIG. 6A is an explanatory diagram for explaining a modification of the lever interlocking mechanism corresponding to FIG. 3A, and FIG. 6B is an explanatory diagram for explaining a modification of the lever interlocking mechanism corresponding to FIG. 5.

DESCRIPTION OF THE PREFERRED EMBODIMENTS

Figure 1:
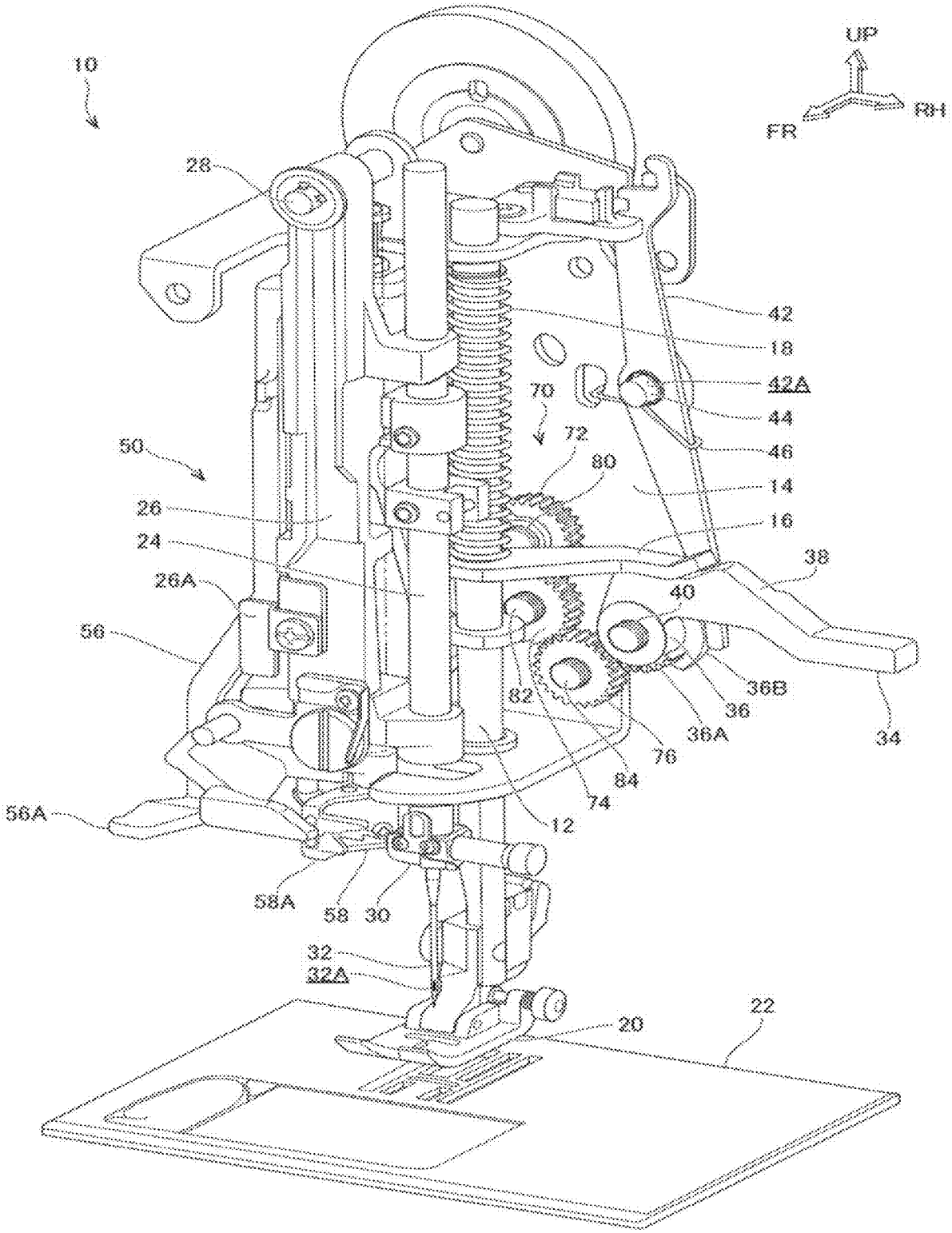
FIG. 1 is a perspective diagram showing main components of a sewing machine according to the present embodiment as viewed diagonally from the front and right.

Description will be made below with reference to the drawings regarding a sewing machine 10 according to the present embodiment. It should be noted that, in the drawings, which are shown as appropriate, the arrow UP indicates the upper side of the sewing machine 10, the arrow FR indicates the front side thereof, and the arrow RH indicates the right side thereof. The directions used in the following description, i.e., the upper-lower direction, the front-rear direction, and the left-right direction, represent the upper and lower, front and rear, and left and right directions of the sewing machine 10, unless otherwise noted.

As shown in FIG. 1, the sewing machine 10 is configured including a presser bar 12, a needle bar 24, an operating lever 34, a release arm 42, a threading apparatus 50, an elevating unit 60 (see FIG. 2), and a lever interlocking mechanism 70. Description will be made below regarding each component of the sewing machine 10.

[Regarding the Presser Bar 12]

The presser bar 12 is structured in a cylindrical shape with the upper-lower direction as its axial direction. The presser bar 12 is supported by a frame 14 such that it can be moved in the upper-lower direction. A presser bar holder 16 is provided at an intermediate portion in the presser bar 12 in the upper-lower direction. The presser bar holder 16 is configured to have an approximately longitudinal plate structure with the upper-lower direction as the thickness direction and such that it extends in the left-right direction. The left-end portion (base portion) of the presser bar holder 16 is bent in an approximately U-shaped structure having an opening that faces the right side, and is fixed to the presser bar 12. Furthermore, an intermediate portion of the presser bar holder 16 in the longitudinal direction is formed to have an approximately crank structure as viewed in a plan view such that the right-end portion (edge portion) of the presser bar holder is arranged rearward of the left-end portion of the presser bar holder 16. With such an arrangement, the right-end portion of the presser bar holder 16 is supported from below by the operating lever 34. This determines the upper-lower positioning with respect to the presser bar 12.

A presser spring 18 configured as a compression spring is mounted on an upper portion of the presser bar 12. The presser spring 18 is arranged above the presser bar holder 16. The lower-end portion of the presser spring 18 is anchored to the presser bar holder 16. Furthermore, the upper-end portion of the presser spring 18 is anchored to the frame 14. This forces the presser bar holder 16 (presser bar 12) downward.

A presser 20 is attached to the lower-end portion of the presser bar 12. In this state, the presser 20 is arranged above a needle plate 22 of the sewing machine 10. With such an arrangement, when the operating lever 34 is set to a non-operating position described later, the presser 20 is arranged at a pressing position (position shown in FIG. 5) above the needle plate 22. When the operating lever 34 is set to an operating position, the presser 20 is arranged at a raised position (position shown in FIGS. 1 and 3A) raised from the pressing position.

[Regarding the Needle Bar 24]

The needle bar 24 is configured to have an approximately cylindrical structure with the upper-lower direction as its axial direction. The needle bar 24 is arranged on the front side of the presser bar 12, and is supported by the needle bar support body 26 such that it can be moved in the upper-lower direction. It should be noted that the needle bar support body 26 is configured in an approximately rectangular columnar shape that extends in the upper-lower direction. The needle bar support body 26 is supported by the frame 14 via a coupling member 28.

A thread hook portion 30 is provided at the lower end portion of the needle bar 24. The thread hook portion 30 is configured in a predetermined plate shape. The thread hook portion 30 is fixed to the lower end portion of the needle bar 24 by screwing. The thread hook portion 30 is configured as a member on which an upper thread is to be hooked after it is drawn from a thread spool (not shown) and is supplied via a balance (not shown).

Furthermore, a needle 32 is fixed to the lower-end portion of the needle bar 24. Specifically, the upper-end portion of the needle 32 is fixed to the lower-end portion of the needle bar 24 by screwing such that the needle 32 extends downward from the needle bar 24. Furthermore, a needle hole 32A is formed as a through hole in the lower-end portion of the needle 32. The needle 32 is fixed to the needle bar 24 such that the needle hole 32A passes through in the front-rear direction.

[Regarding the Operating Lever 34]

The operating lever 34 is arranged below the edge-side portion of the presser bar holder 16. The operating lever is rotatably supported by the frame 14 with the front-rear direction as its axial direction. The operating lever is configured such that it can be rotated between the non-operating position (position shown in FIG. 5) and the operating position (position shown in FIGS. 1 and 3A). It should be noted that description will be made regarding a state in which the operating lever 34 is arranged at the operating position.

As shown in FIGS. 1 through 3A and 3B, the operating lever 34 is configured to have an approximately longitudinal plate structure with the front-rear direction as the thickness direction and such that it extends in the left-right direction. Specifically, the operating lever 34 is configured including a rotation support portion 36 and a lever main body 38.

The rotation support portion 36 is configured in an approximately cylindrical shape with the front-rear direction as its axial direction. With such an arrangement, a support shaft 40 provided to the frame 14 is inserted into the rotation support portion 36. With this, the rotation support portion 36 is rotatably supported by the support shaft 40. A lever-side gear portion 36A is formed in a lower portion of the outer circumferential portion of the rotation support portion 36. The lever-side gear portion 36A is configured as multiple gear teeth such that it extends along the circumferential direction of the rotation support portion 36.

An arm cam 36B is formed in the rear-end portion of the outer circumferential portion of the rotation support portion 36 so as to operate the release arm 42 described later. The arm cam 36B is configured as a plate cam with the front-rear direction as its thickness direction such that it protrudes rightward from the rotation support portion 36.

The lever main body 38 is configured such that it extends in the left-right direction and such that it extends rightward from the upper portion of the rotation support portion 36. A first cam face 38A and a second cam face 38B are formed on the outer circumferential face of the left-end portion of the lever main body 38. The first cam face 38A is configured such that it extends upward from the outer circumferential face of the rotation support portion 36. The second cam face 38B is configured such that it extends rightward from the upper end of the first cam face 38A. More specifically, as viewed in a plan view, the first cam face 38A is configured to have a slope that inclines slightly to the right as it extends upward. The second cam face 38B is configured such that it extends along the left-right direction.

With such an arrangement, when the operating lever 34 is set to the operating position, the edge portion of the presser bar holder 16 is arranged on the second cam face 38B, and the presser 20 is held at the raised position. On the other hand, when the operating lever 34 is turned from the operating position to the non-operating position side, the boundary between the second cam face 38B and the first cam face 38A is slid along the lower face of the presser bar holder 16, thereby lowering the presser bar holder 16 (see FIG. 4A). When the operating lever 34 is further turned by a predetermined angle from the operating position, the first cam face 38A is slid along the lower face of the presser bar holder 16 (see FIG. 4B). When the operating lever 34 reaches the non-operating position, the edge portion of the presser bar holder 16 is arranged such that it is in contact with the outer circumferential portion of the rotation support portion 36 (see FIG. 5). With this, such an arrangement allows the presser 20 to be lowered from the raised portion to the pressing position.

[Regarding the Release Arm 42]

Figure 2:
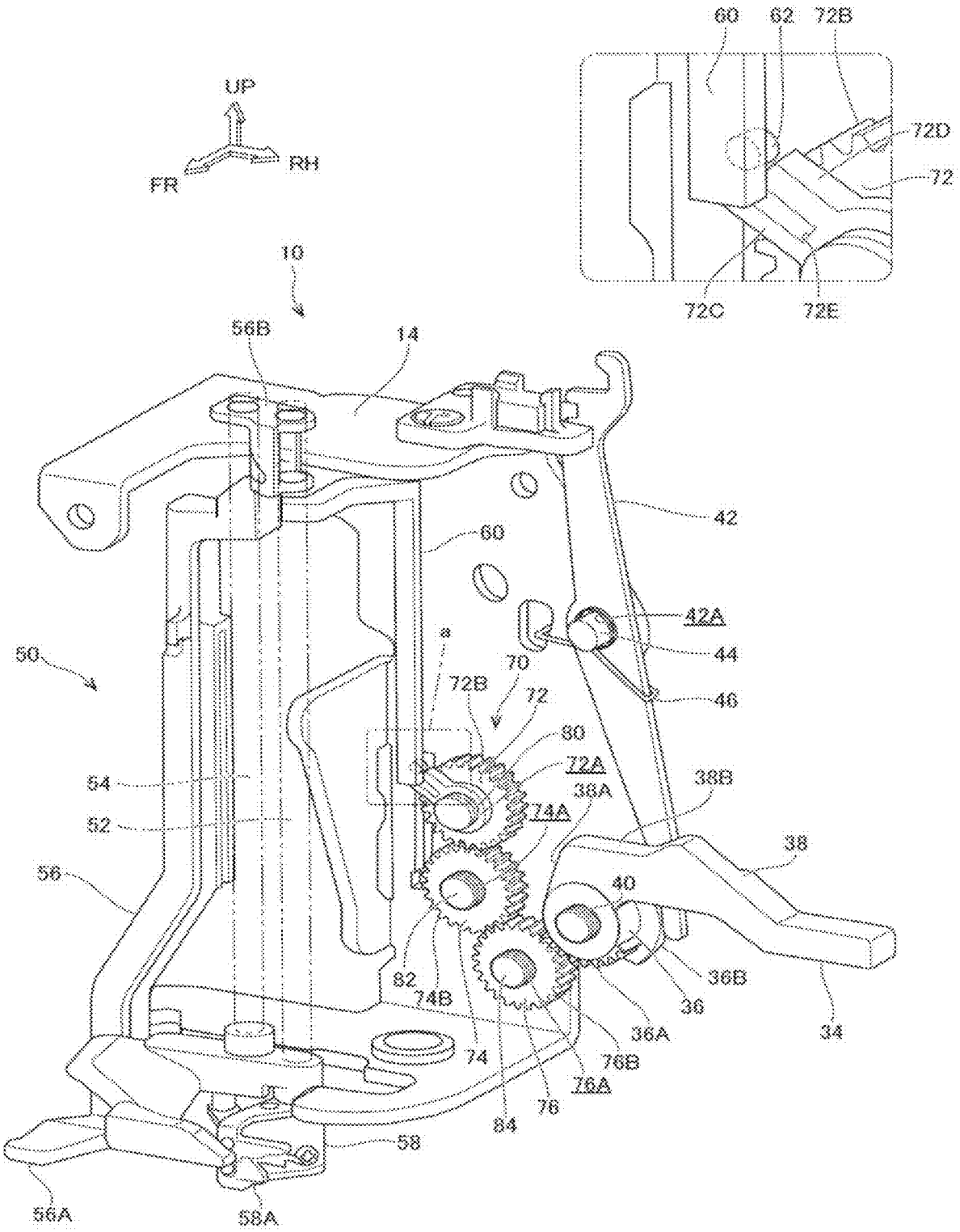
FIG. 2 is a perspective diagram showing the main components with a presser bar and a needle bar omitted, as viewed diagonally from the front and right.

As shown in FIGS. 1 and 2, the release arm 42 is configured to have an approximately longitudinal plate structure with the front-rear direction as its thickness direction and with the upper-lower direction as its longitudinal direction. A support hole 42A is formed as a through hole in an intermediate portion in the release arm 42 in the longitudinal direction. With such an arrangement, the arm shaft 44 provided to the frame 14 is inserted into the support hole 42A. In this state, the release arm 42 is rotatably supported by the arm shaft 44 with the front-rear direction as its axial direction.

The lower-end portion of the release arm 42 is arranged on the rear side of the lever main body 38 of the operating lever 34. Furthermore, the lower-end portion of the release arm 42 is arranged adjacent to the right side of the arm cam 36B of the operating lever 34. Furthermore, an arm force-applying spring 46 configured as a torsion spring is attached to the arm shaft 44. One end portion of the arm force-applying spring 46 is anchored to the frame 14. The other end portion of the arm force-applying spring 46 is anchored to the release arm 42. As viewed in a front view, the arm force-applying spring 46 forces the release arm 42 such that it is turned in the clockwise direction. With this, the lower-end portion of the release arm 42 is pressed in contact with the arm cam 36B of the operating lever 34. The release arm 42 is configured such that, upon turning the operating lever 34 from the operating position to the non-operating position, the release arm 42 is turned by the arm cam 36B in a clockwise manner with the arm shaft 44 as the rotational axis.

Furthermore, the upper-end portion of the release arm 42 is coupled to a pair of thread tension discs configured to pinch an upper thread. The release arm 42 is configured such that, upon turning the operating lever 34 from the operating position to the non-operating position, the pair of thread tension discs transit from an open state to a closed state (in a state in which the upper thread is pinched between them) by the rotation of the release arm 42.

[Regarding the Threading Apparatus 50]

Figure 3B:
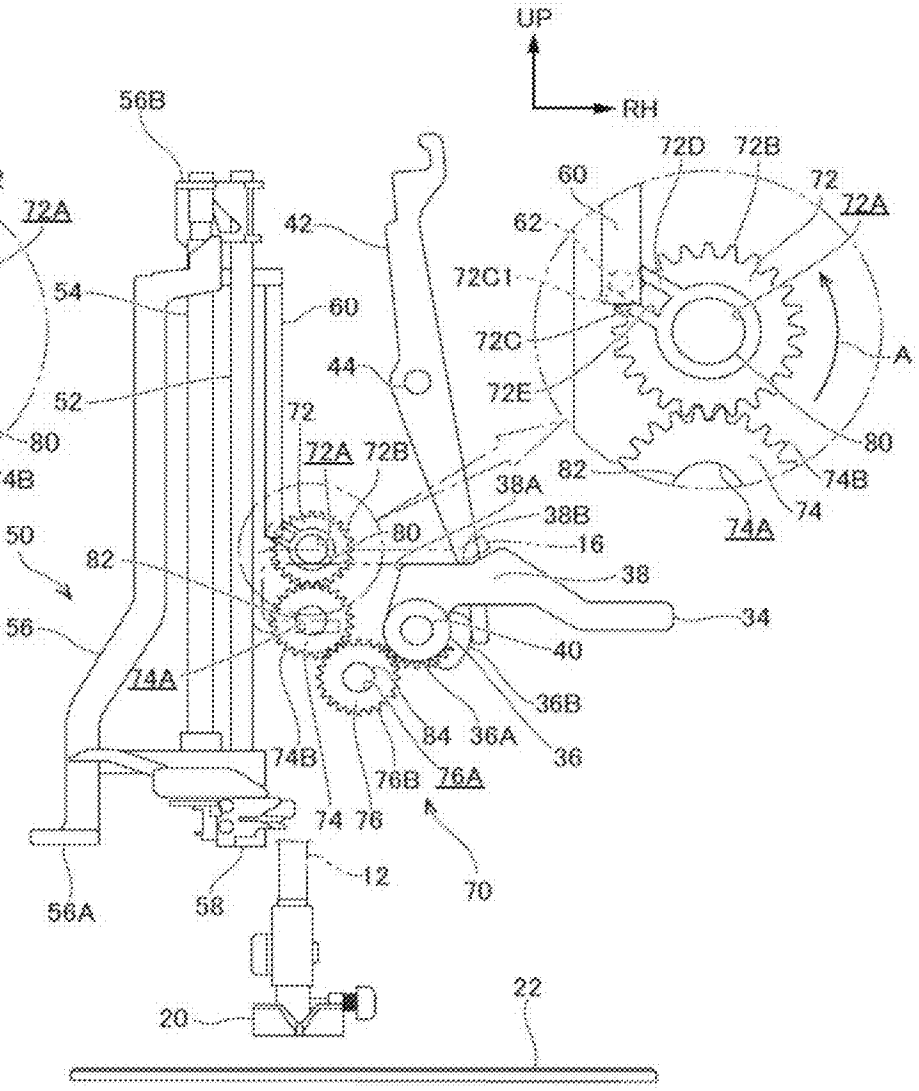
FIG. 3B is a front view showing a state in which an operating shaft comes in contact with an engagement portion of a first gear after the threading lever is pressed downward from a state shown in FIG. 3A.
Figure 3A:
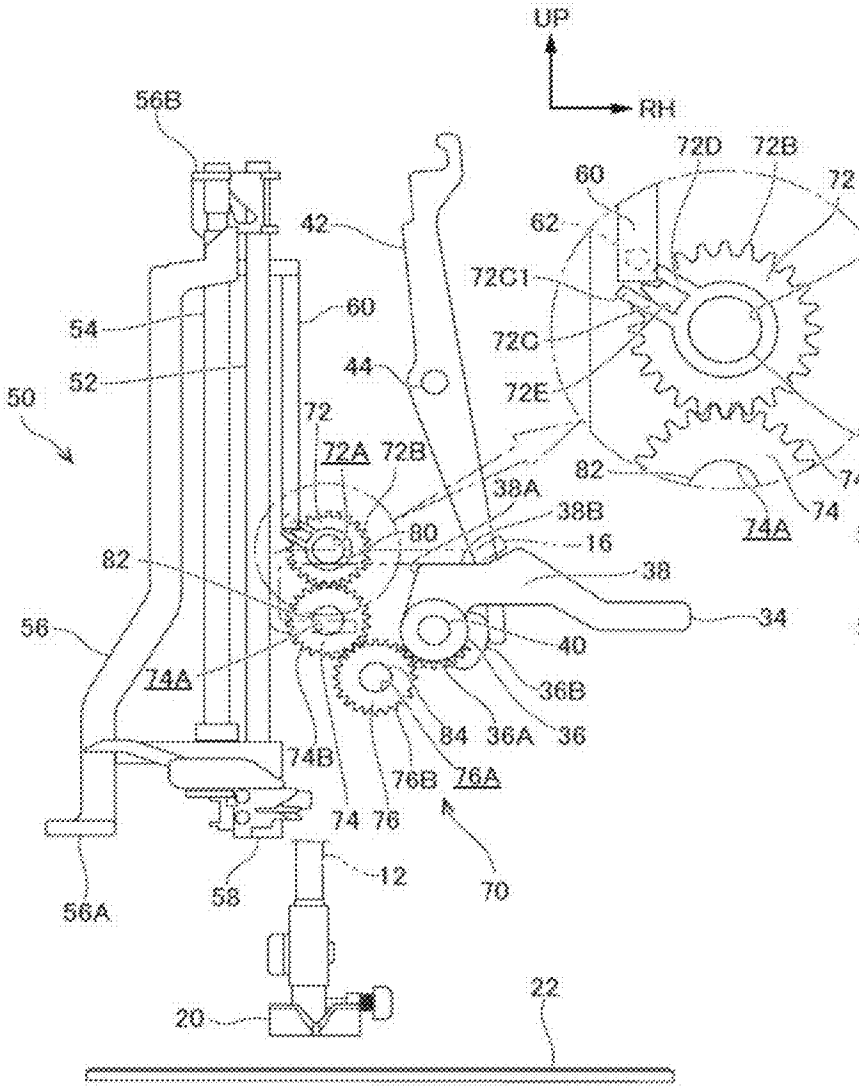
FIG. 3A is a front view showing a state in which a threading lever of a threading apparatus shown in FIG. 2 is set to an initial position and an operating lever is set to an operating position.

As shown in FIGS. 2, 3A, and 3B, the threading apparatus 50 is configured including a threading shaft 52, a guide shaft 54, a threading lever 56, and a threading mechanism unit 58.

The threading shaft 52 is configured to have an approximately cylindrical structure with the upper-lower direction as its axial direction. The threading shaft 52 is arranged on the rear side of the needle bar support body 26 (not shown in FIGS. 2 and 3). The threading shaft 52 is supported by the needle bar support body 26 such that it can be moved in the upper-lower direction. The guide shaft 54 is configured to have an approximately cylindrical structure with the upper-lower direction as its axial direction. The guide shaft 54 is arranged on the left side of the threading shaft 52. The guide shaft 54 is supported by the needle bar support body 26 such that it can be moved in the upper-lower direction.

The threading lever 56 is configured to have an approximately rectangular columnar structure such that it extends in the upper-lower direction. The threading lever 56 is arranged on the left side of the needle bar support body 26. The threading lever 56 is supported by a support member 26A fixed to the needle bar support body 26 such that it can be moved in the upper-lower direction. The threading lever 56 is configured as a member that allows the user to operate the threading apparatus 50 manually. The threading apparatus 50 is configured such that, upon pressing the threading lever 56 downward, the threading apparatus 50 operates. Specifically, when the threading apparatus 50 is set to the non-operating state, the threading lever 56 is set to an initial position (position indicated in FIG. 3A). Subsequently, upon pressing the threading lever 56 downward from the initial position, the threading lever 56 is lowered to a second pressed-down position (position indicated by the line of alternately long and two short dashes) via a first pressed-down position (position indicated by the line of alternately long and short dashes). It should be noted that the threading lever 56 is forced upward by an unshown lever force-applying spring. This holds the threading lever 56 at the initial position.

Furthermore, a knob portion 56A is formed in the lower-end portion of the threading lever 56 such that it is bent frontward. On the other hand, a support portion 56B is formed in the upper-end portion of the threading lever 56 such that it protrudes rightward. With such an arrangement, the upper-end portions of the threading shaft 52 and the guide shaft 54 are supported by the support portion 56B. Such an arrangement allows the threading shaft 52 and the guide shaft 54 to be raised and lowered together with the threading lever 56 between the initial position and the first pressed-down position. Furthermore, with such an arrangement, when the threading lever 56 is lowered from the first pressed-down position to the second pressed-down position, the threading shaft 52 is rotated around its axis while maintaining the threading shaft 52 and the guide shaft 54 at the first pressed-down position.

The threading mechanism unit 58 is provided to the lower-end portions of the threading shaft 52 and the guide shaft 54. The threading mechanism unit 58 includes a thread holder unit 58A. The thread holder unit 58A is configured as a member that holds an upper thread supplied via the thread hook portion 30. The thread mechanism unit 58 is configured such that, when the threading lever 56 is lowered from the first pressed-down position to the second pressed-down position, the threading mechanism unit 58 turns around the needle 32 so as to perform a thread insertion operation in which the upper thread is inserted through the needle hole 32A of the needle 32.

[Regarding the Elevating Unit 60]

The elevating unit 60 is configured to have an approximately longitudinal plate structure with the front-rear direction as its thickness direction such that it extends in the upper-lower direction. The elevating unit 60 is arranged on the rear side of the presser bar 12. Furthermore, the elevating unit 60 is configured such that its upper-end portion is bent frontward. The upper end of the elevating unit 60 is connected to the upper-end portion of the threading lever 56. Such an arrangement allows the elevating unit 60 to be raised and lowered as a single unit together with the threading lever 56. That is to say, with this arrangement, the elevating unit 60 is lowered together with the threading lever 56 from the initial position to the second pressed-down position via the first pressed-down position. Furthermore, an operating shaft 62 is provided to the lower-end portion of the elevating unit 60. The operating shaft 62 is configured to have a cylindrical structure with the front-rear direction as its axial direction such that it protrudes rearward from the elevating unit 60.

[Regarding the Lever Interlocking Mechanism 70]

As shown in FIGS. 1 through 3A and 3B, the lever interlocking mechanism 70 is configured as a gear train. The lever interlocking mechanism 70 is coupled to the operating lever 34. Specifically, the lever interlocking mechanism 70 is configured including a first gear 72, a second gear 74, and a third gear 76, each of which is configured as a "coupling gear".

The first gear 72 is configured to have a disk-shaped structure with the front-rear direction as its thickness direction. The first gear 72 is arranged such that it is positioned on the rear side of the elevating unit 60 and diagonally downward and rightward from the operating shaft 62. A first gear hole 72A is formed as a through hole in a central portion of the first gear 72. With such an arrangement, a first gear shaft 80 provided to the frame 14 is inserted into the gear hole 72A. In this state, the first gear 72 is rotatably supported by the first gear shaft 80 with the front-rear direction as its axial direction. Furthermore, a first gear portion 72B configured as multiple gear teeth is formed along the outer circumferential portion of the first gear 72. The first gear portion 72B is formed over the overall circumferential face of the first gear 72.

A pair of engagement walls 72C and 72D are formed on the front face of the first gear 72. As viewed in a front view, the pair of engagement walls 72C and 72D are tilted such that they are inclined upward as they extend toward the left side. Furthermore, the pair of engagement walls 72C and 72D are arranged in parallel such that they are positioned side by side along a direction that is orthogonal to the radial direction of the first gear 72. With this, an engagement groove 72E is defined between the pair of the engagement walls 72C and 72D. The engagement groove 72E is configured to have an opening that faces the front side and the outer side in the radial direction of the first gear 72 (specifically, the diagonally upper-left side). Furthermore, one of the engagement walls, i.e., the engagement wall 72C, is arranged such that it is closer to a side in the rotational direction of the first gear 72 with respect to the engagement groove 72E. The other one of the engagement walls, i.e., the engagement wall 72D, is arranged such that it is closer to the other side in the rotational direction of the first gear 72 with respect to the engagement groove 72E. Furthermore, the engagement wall 72E is configured to have a groove width that is slightly larger than the diameter of the operating shaft 62. This arrangement allows the operating shaft 62 to be inserted into the engagement groove 72E.

The end portion of the engagement wall 72C is configured as an engagement portion 72C1. The engagement portion 72C1 is configured such that it protrudes outward in the radial direction of the first gear 72 as compared with the end portion of the engagement wall 72D. Furthermore, the engagement portion 72C1 is arranged below the operating shaft 62 with a gap between them. That is to say, the engagement portion 72C1 is arranged below the operating shaft 62 with a gap between them such that it is positioned on a path along which the operating shaft 62 is to be moved in the upper-lower direction. With this, when the threading lever 56 is lowered from the initial position, the operating shaft 62 is engaged with the engagement portion 72C1, which rotates the first gear 72 in one rotational direction.

As with the first gear 72, the second gear 74 is formed to have a disk-shaped structure with the front-rear direction as its thickness direction. The second gear 74 is arranged below the first gear 72. A second gear hole 74A is formed as a through hole in a central portion of the second gear 74. With such an arrangement, a second gear shaft 82 provided to the frame 14 is inserted into the second gear hole 74A. In this state, the second gear 74 is rotatably supported by the second gear shaft 82 with the front-rear direction as its axial direction. Furthermore, a second gear portion 74B configured as multiple gear teeth is formed along the outer circumferential face of the second gear 74. The second gear portion 74B is formed over the overall circumferential face of the second gear 74. With such an arrangement, the second gear 74 is arranged such that its second gear portion 74B meshes with the first gear portion 72B of the first gear 72.

As with the second gear 74, the third gear 76 is formed to have a disk-shaped structure with the front-rear direction as its thickness direction. The third gear 76 is arranged such that it is positioned diagonally downward and rightward from the second gear 74 and diagonally downward and leftward from the rotation support portion 36 provided to the operating lever 34, i.e., such that it is positioned between the second gear 74 and the rotation support portion 36 provided to the operating lever 34. A third gear hole 76A is formed as a through hole in a central portion of the third gear 76. With such an arrangement, a third gear shaft 84 provided to the frame 14 is inserted into the third gear hole 76A. In this state, the third gear 76 is rotatably supported by the third gear shaft 84 with the front-rear direction as its axial direction. Furthermore, a third gear portion 76B configured as multiple gear teeth is formed along the outer circumferential portion of the third gear 76. The third gear portion 76B is formed over the overall circumferential face of the third gear 76. With such an arrangement, the third gear 76 is arranged such that the third gear portion 76B thereof meshes with the second gear portion 74B of the second gear 74 and the lever-side gear portion 36A of the operating lever 34. With this, the lever interlocking mechanism 70 (the first gear 72 through the third gear 76) interlocks with the operating lever 34. With such an arrangement, the lever interlocking mechanism 70 interlocks with the rotation of the operating lever 34.

That is to say, upon pressing the threading lever 56 downward from the initial position, the first gear 72 is rotated in the one rotational direction by the operating shaft 62. With this, the operating lever 34 is turned from the operating position to the non-operating position by the lever interlocking mechanism 70. It should be noted that the position at which the end portion of the engagement wall 72D is to be arranged is designed such that, when the threading lever 56 is maintained at the initial position (in the non-operating state of the threading apparatus 50), and when the operating lever 34 is turned from the operating position to the non-operating position so as to rotate the first gear 72 in the one rotational direction, the engagement wall 72D of the first gear 72 does not engage with the operating shaft 62. That is to say, with such an arrangement, in a state in which the threading lever 56 is maintained at the initial position, when the operating lever 34 is turned between the operating position and the non-operating position, the lever interlocking mechanism 70 (first gear 72) that interlocks with the operating lever 34 does not engage with the elevating unit 60 (operation shaft 62).

Furthermore, with such an arrangement, when the threading lever 56 is pressed downward from the initial position such that the operating lever 34 is turned from the operating position to the non-operating position side, the engagement between the engagement groove 72E of the first gear 72 and the operating shaft 62 is released, and the operating lever 34 is set to the non-operating position before the threading lever 56 reaches the first pressed-down position. Furthermore, when the operating lever 34 is set to the non-operating position, the engagement portion 72C1 of the first gear 72 is arranged at a position displaced toward the right side from the path along which the operating shaft 62 is to be moved in the upper-lower direction. More specifically, when the operating lever 34 is set to the non-operating position, the engagement walls 72C and 72D of the first gear 72 are arranged at positions displaced toward the right side from the path of the operating shaft 62 (see FIG. 5).

[Operation and Effects]

Description will be made below regarding the operation and the effects of the present embodiment with reference to the operation when the threading apparatus 50 is operated in a state in which the operating lever 34 is set to the operating position.

As shown in FIG. 3A, when the threading apparatus 50 is set to the non-operating state, the threading lever 56 and the elevating unit 60 are set to the initial positions. Furthermore, when the operating lever 34 is set to the operating position, the presser 20 is set to the raised position. In this state, the engagement portion 72C1 of the first gear 72 included in the lever interlocking mechanism 70 is arranged at a position below the operating shaft 62 of the elevating unit 60 with a gap between them. Furthermore, in this state, the pair of thread tension discs is set to the open state by the release arm 42.

In this state, when the operator grips the knob portion 56A of the threading lever 56 and presses the threading lever 56 downward such that it is lowered from the initial position, the threading mechanism unit 58 of the threading apparatus 50 and the elevating unit 60 are lowered together with the threading lever 56. Subsequently, as shown in FIG. 3B, the operating shaft 62 of the elevating unit 60 comes in contact with the engagement portion 72C1 of the first gear 72, thereby engaging the operating shaft 62 with the first gear 72. It should be noted that, in the state shown in FIG. 3B, the operating lever 34 is set to the operating position, and the presser 20 is set to the raised position.

Upon further pressing the threading lever 56 downward in this state, the operating shaft 62 of the elevating unit 60 presses the engagement portion 72C1 of the first gear 72 downward, which rotates the first gear 72 in the one rotational direction (in the direction indicated by the arrow A in FIG. 3B). Subsequently, as shown in FIG. 4A, after the first gear 72 is rotated in the one rotational direction, the operating shaft 62 is inserted into the engagement groove 72E of the first gear 72. Furthermore, in this stage, the second gear 74 and the third gear 76 included in the lever interlocking mechanism 70 are rotated. This rotates the operating lever 34 meshed with the third gear 76 from the operating position to the non-operating position side. That is to say, the operating force (pressing and lowering force) applied from the threading lever 56 is transmitted to the operating lever 34 via the lever interlocking mechanism 70, thereby rotating the operating lever 34.

When the operating lever 34 is turned from the operating position to the non-operating position side, the boundary between the first cam face 38A and the second cam face 38B of the operating lever 34 is slid along the lower face of the presser bar holder 16, which lowers the presser bar holder 16 (i.e., presser bar 12). This lowers the presser 20 from the raised position. Furthermore, when the operating lever 34 is turned from the operating position, the release arm 42 is turned by the arm cam 36B of the operating lever 34 in a clockwise manner with the arm shaft 44 as the rotational axis as viewed in a front view.

Figure 4B:
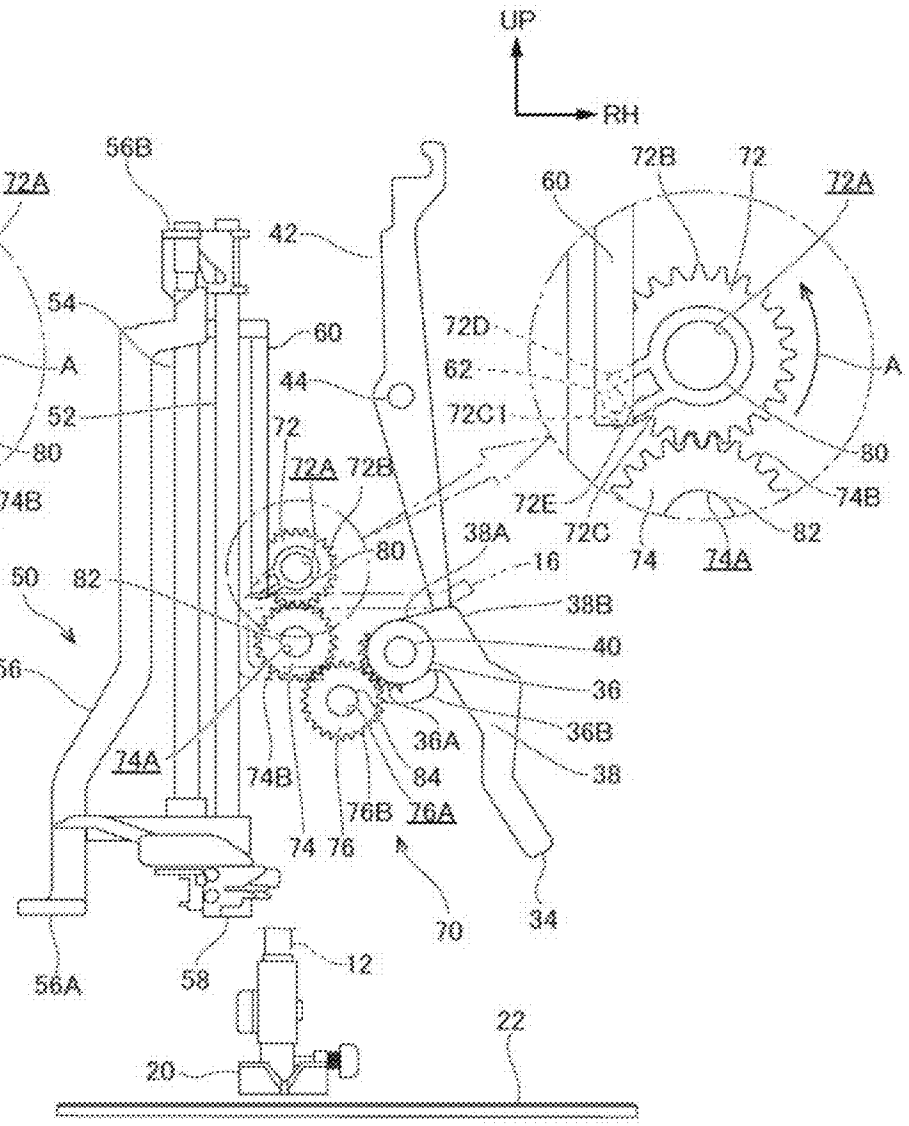
FIG. 4B is a front view showing a state in which the threading lever is further pressed downward from the state shown in FIG. 4A.
Figure 4A:
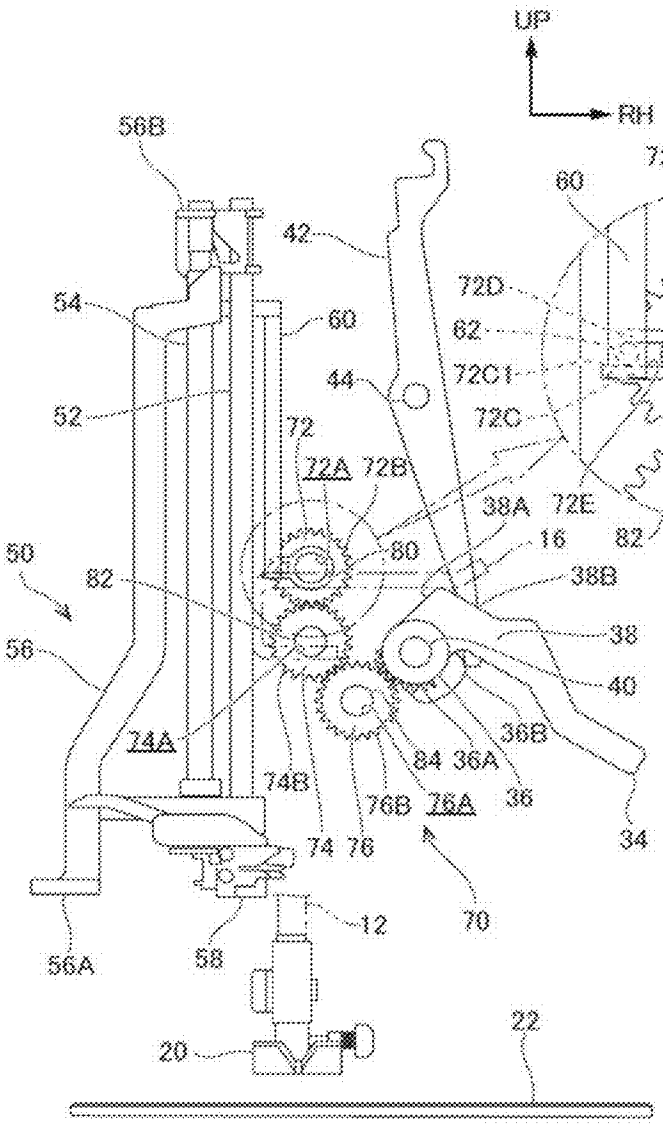
FIG. 4A is a front view showing a state in which the operating shaft is inserted into an engagement groove of the first gear after the threading lever is further pressed downward from the state shown in FIG. 3B.

As shown in FIG. 4B, upon further pressing the threading lever 56 downward from the state shown in FIG. 4A, the first gear 72, the second gear 74, and the third gear 76 included in the lever interlocking mechanism 70 are further rotated by the operating shaft 62, thereby further turning the operating lever 34 toward the non-operating position side. This further lowers the presser bar 12 and the presser 20. At the same time, the release arm 42 is further turned. Furthermore, in this state, the operating shaft 62 is moved to the opening portion side of the engagement groove 72E of the first gear 72, and the operating shaft 62 is engaged with the engagement portion 72C1. Furthermore, in this state, the sliding position of the operating lever 34 via which the operating lever 34 is slid along the presser bar holder 16 transits from the boundary between the first cam face 38A and the second cam face 38B to the first cam face 38A. In this stage, the force applied downward from the presser spring 18 applied to the first cam face 38A of the operating lever 34 via the presser bar holder 16.

Figure 5:
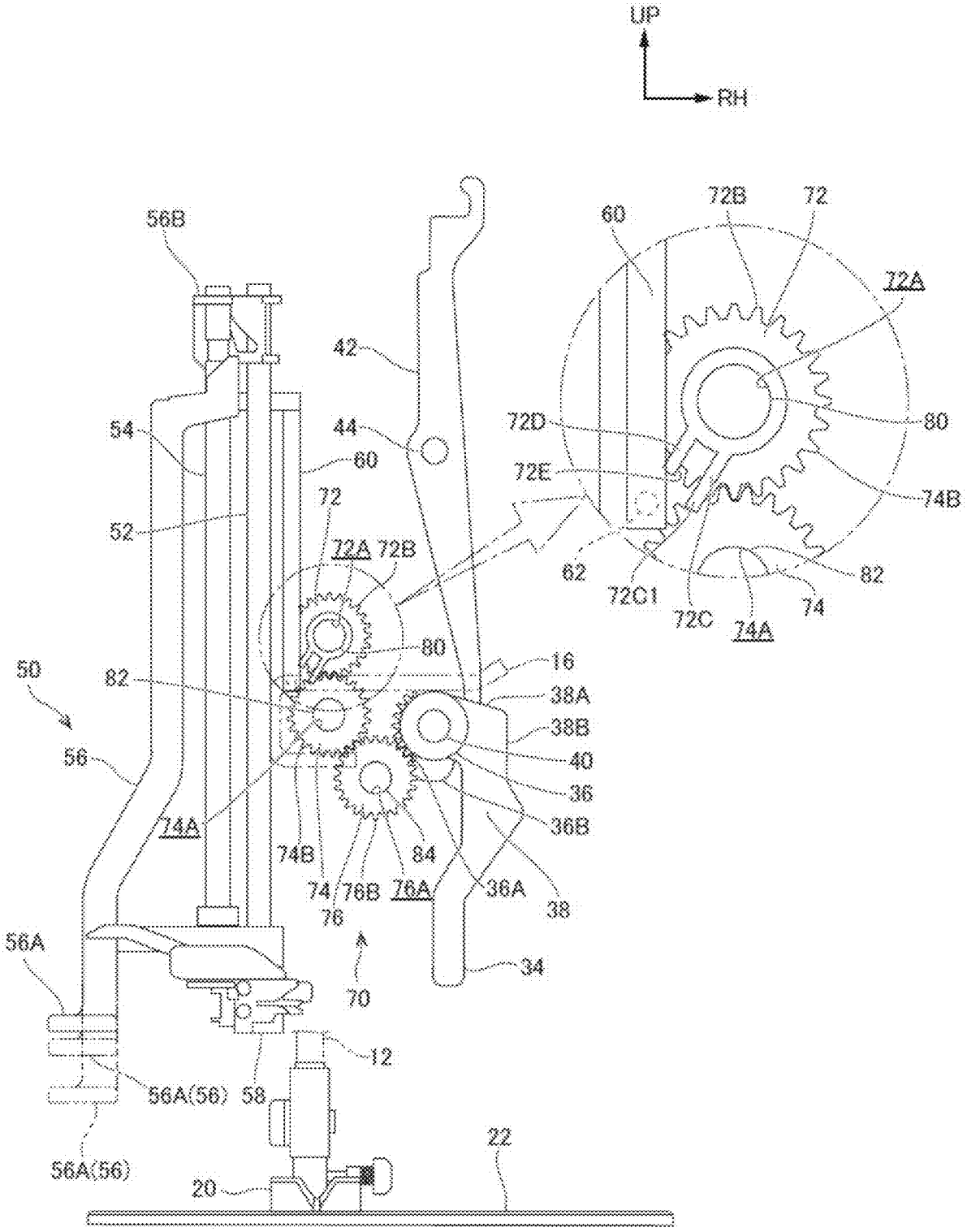
FIG. 5 is a front view showing a state in which the threading lever is arranged at a position immediately before a first pressed-down position after the threading lever is further pressed downward from the state shown in FIG. 4B.

As shown in FIG. 5, when the threading lever 56 is pressed downward to a positron immediately before the first pressed-down position, the operating lever 34 is set to the non-operating position. With this, the presser 20 is lowered to the pressing position, and is arranged adjacent to the upper side of the needle plate 22. Furthermore, in this state, the engagement state between the operating shaft 62 of the elevating unit 60 and the engagement portion 72C1 of the first gear 72 is released. Specifically, the engagement wall 72C (including the engagement portion 72C1) and the engagement wall 72D of the first gear 72 are arranged at a position displaced rightward from the path of the operating shaft 62. It should be noted that, when the operating lever 34 is set to the non-operating position, the pair of thread tension discs is set to the closed state by the release arm 42.

Upon further pressing the threading lever 56 downward from the state shown in FIG. 5, the threading lever 56 reaches the first pressed-down position (see the threading lever 56 indicated by the line of alternately long and short dashes in FIG. 5). In this stage, the threading mechanism unit 58 of the threading apparatus 50 and the elevating unit 60 are lowered to the first pressed-down positions together with the threading lever 56, which are not shown in the drawings. It should be noted that, in this state, the engagement state between the operating shaft 62 of the elevating unit 60 and the engagement portion 72C1 of the first gear 72 has been already released. Accordingly, the operating lever 34 is maintained at the non-operating position. At the same time, the presser 20 is maintained at the pressing position.

Subsequently, upon further pressing the threading lever 56 downward from the first pressed-down position to the second pressed-down position (see the threading lever 56 indicated by the line of alternately long and two short dashes in FIG. 5), the threading mechanism unit 58 of the threading apparatus 50 turns around the needle 32 in a state in which the presser 20 is set to the pressing position, so as to perform a thread insertion operation in which an upper thread is inserted through the needle hole 32A of the needle 32. With this, the threading operation of the threading apparatus 50 is completed in which an upper thread is inserted through the needle hole 32A of the needle 32.

It should be noted that, after the completion of the threading operation of the threading apparatus 50, the pressing-down operation of the threading lever 56 is released. In this state, the threading lever 56 is raised from the second pressed-down position and is returned to the initial position by the force applied from the lever force-applying spring. Furthermore, when the threading lever 56 is raised, the elevating unit 60 is also raised together with the threading lever 56. It should be noted that, in this stage, the engagement walls 72C and 72D of the first gear 72 are set to positions displaced toward the right side from the path of the operating shaft 62. Accordingly, the elevating unit 60 is raised together with the threading lever 56 without interference between the operating shaft 62 and the engagement walls 72C and 72D.

As described above, the sewing machine 10 according to the present embodiment is configured to allow the elevating unit 60 to be raised and lowered together with the threading lever 56 of the threading apparatus 50 as a single unit. Furthermore, the lever interlocking mechanism 70 is coupled to the operating lever 34 such that it interlocks with the rotational operation of the operating lever 34. With such an arrangement, upon pressing the threading lever 56 downward from the initial position in a state in which the operating lever 34 is set to the operating position, the elevating unit 60 (the operating shaft 62 thereof) is engaged with the lever interlocking mechanism 70 (the first gear 72 thereof). In this state, the operating force applied to the threading lever 56 is transmitted to the operating lever 34 via the lever interlocking mechanism 70, thereby turning the operating lever 34 from the operating position to the non-operating position.

Accordingly, when the threading apparatus 50 is to be operated, upon pressing the threading lever 56 downward, the operating lever 34 is turned from the operating position to the non-operating position so as to return the presser 20 to the pressing position even when the presser 20 is set to the raised position. That is to say, by manually pressing the threading lever 56 of the threading apparatus 50 downward without using a driving unit configured as a motor or the like, this arrangement allows the presser 20 set to the raised position to be returned to the pressing position that does not interfere with the threading apparatus 50. With this, the user is not required to perform an operation in which the operating lever 34 set to the operating position is turned to the non-operating position before the operation of the threading apparatus 50. Accordingly, with the sewing machine 10 according to the present embodiment, this arrangement provides improved operation efficiency while suppressing an increase in costs.

Furthermore, the lever-side gear portion 36A is formed in the operating lever 34. Moreover, the lever interlocking mechanism 70 is configured as a gear train (the first gear 72, the second gear 74, and the third gear 76) coupled to the lever-side gear portion 36A. Accordingly, this arrangement allows the operating force applied to the threading lever 56 to be transmitted to the operating lever 34 in a simple manner.

Furthermore, the operating shaft 62 is provided to the elevating unit 60 of the threading apparatus 50. Moreover, the engagement portion 72C1 configured to be engaged with the operating shaft 62 is provided to the first gear 72 of the lever interlocking mechanism 70. With such an arrangement, when the threading lever 56 is set to the initial position and the operating lever 34 is set to the operating position, the engagement portion 72C1 of the first gear 72 is arranged at a position on the path of the operating shaft 62 and below the operating shaft 62 with a gap between them. Accordingly, upon pressing the threading lever 56 downward from the initial position, the operating shaft 62 is engaged with the engagement portion 72C1, which allows the lever interlocking mechanism 70 (the first gear 72, the second gear 74, and the third gear 76) to be operated. With this, the operating force applied to the threading lever 56 is transmitted to the operating lever 34 via the lever interlocking mechanism 70, thereby allowing the operating lever 34 to be turned from the operating position to the non-operating position.

Furthermore, with such an arrangement, in the non-operating state of the threading apparatus 50, when the operating lever 34 is turned from the operating position to the non-operating position side so as to rotate the first gear 72 in the one rotational direction, the engagement wall 72D of the first gear 72 is not engaged with the operating shaft 62. That is to say, with such an arrangement, when the operating lever 34 is turned between the non-operating position and the operating position in a state in which the threading lever 56 is set to the initial position, the lever interlocking mechanism 70 (the first gear 72 thereof) is not engaged with the elevating unit 60 (the operating shaft 62 thereof). Accordingly this arrangement is capable of preventing the operation of the threading apparatus 50 when the operating lever 34 is turned. That is to say, by operating the operating lever 34, this arrangement allows the presser 20 to be raised and lowered independent of the threading operation of the threading apparatus 50.

On the other hand, as described above, upon pressing the threading lever 56 downward from the initial position in a state in which the operating lever 34 is set to the operating position, the operating lever 34 is moved to the non-operating position by the lever interlocking mechanism 70 before the threading lever 56 reaches the first pressed-down position. That is to say, the presser 20 is returned to the pressing position. Subsequently, when the threading lever 56 is lowered from the first pressed-down position to the second pressed-down position, the threading mechanism unit 58 of the threading apparatus 50 performs a thread insertion operation in which an upper thread is inserted into the needle hole 32A of the needle 32. This arrangement allows the presser 20 to be returned to the pressing position before the thread insertion operation of the threading mechanism unit 58.

Furthermore, the engagement state between the engagement portion 72C1 of the first gear 72 included in the lever interlocking mechanism 70 and the operating shaft 62 of the elevating unit 60 is released before the threading lever 56 reaches the first pressed-down position. That is to say, when the operating lever 34 is set to the non-operating position, the transmission of the operating force applied via the operating shaft 62 of the elevating unit 60 to the engagement portion 72C1 of the first gear 72 is disconnected. Accordingly, when the threading lever 56 is further pressed downward from the first pressed-down position to the second pressed-down position in order to instruct the threading mechanism unit 58 to execute the thread insertion operation, this arrangement is capable of preventing the transmission of the operating force applied to the threading lever 56 to the operating lever 34 set to the non-operating position. This allows the operating lever 34 to be prevented from further turning from the non-operating position when the threading lever 56 is pressed downward from the first pressed-down position to the second pressed-down position, and to maintain the presser 20 at the pressing position.

With such an arrangement, when the operating lever 34 is set to the non-operating position, the engagement wall 72C (including the engagement portion 72C1) and the engagement wall 72D of the first gear 72 are arranged at positions displaced toward the right side from the path of the operating shaft 62. With this, when the threading lever 56 is pressed downward from the initial position in a state in which the presser 20 has been set at the pressing position, the operating shaft 62 is not engaged with the engagement portion 72C1 of the first gear 72. Accordingly, when the operating lever 34 is set to the non-operating position, such an arrangement allows the threading apparatus 50 to be operated independent of the operating lever 34 and the lever interlocking mechanism 70.

Furthermore, the engagement groove 72E is provided to the first gear 72. With such an arrangement, upon pressing the threading lever 56 downward in a state in which the operating lever 34 is set to the operating position, the operating shaft 62 is engaged with the engagement portion 72C1 of the first gear 72, following which the operating shaft 62 is inserted into the engagement groove 72E while pressing the engagement portion 72C1 downward. With this, after the operating shaft 62 is inserted into the engagement groove 72E, the operating shaft 62 and the engagement groove 72E are engaged with each other with respect to both rotational directions of the first gear 72. This interlocks the pressing-down of the threading lever 56 and the rotation of the operating lever 34. As a result, when the operating lever 34 is turned from the operating position to the non-operating position by pressing the threading lever 56 downward, this arrangement suppresses sudden lowering of the pressing bar 12 (i.e., the presser 20) forced by the pressing spring 18. Furthermore, in a latter stage of the operation in which the threading lever 56 is pressed downward, the force applied from the presser spring 18 is transmitted to the operating shaft 62 via the operating lever 34 and the lever interlocking mechanism 70. More specifically, after the sliding portion of the operating lever 34 via which it is slid along the presser bar holder 16 transits from the boundary between the first cam face 38A and the second cam face 38B to the first cam face 38A, the force applied from the presser spring 18 is transmitted to the operating shaft 62 via the operating lever 34 and the lever interlocking mechanism 70. In this state, the force is applied downward from the presser spring 18 to the operating shaft 62 (i.e., the threading lever 56). With this, in a latter stage of the operation in which the threading lever 56 is pressed downward, this arrangement allows the required operating force (pressing force) for operating the threading lever 56 to be reduced. Accordingly, this arrangement provides improved operability for the threading lever 56.

[Regarding a Modification of the Lever Linkage Mechanism 70]

Figure 6B:
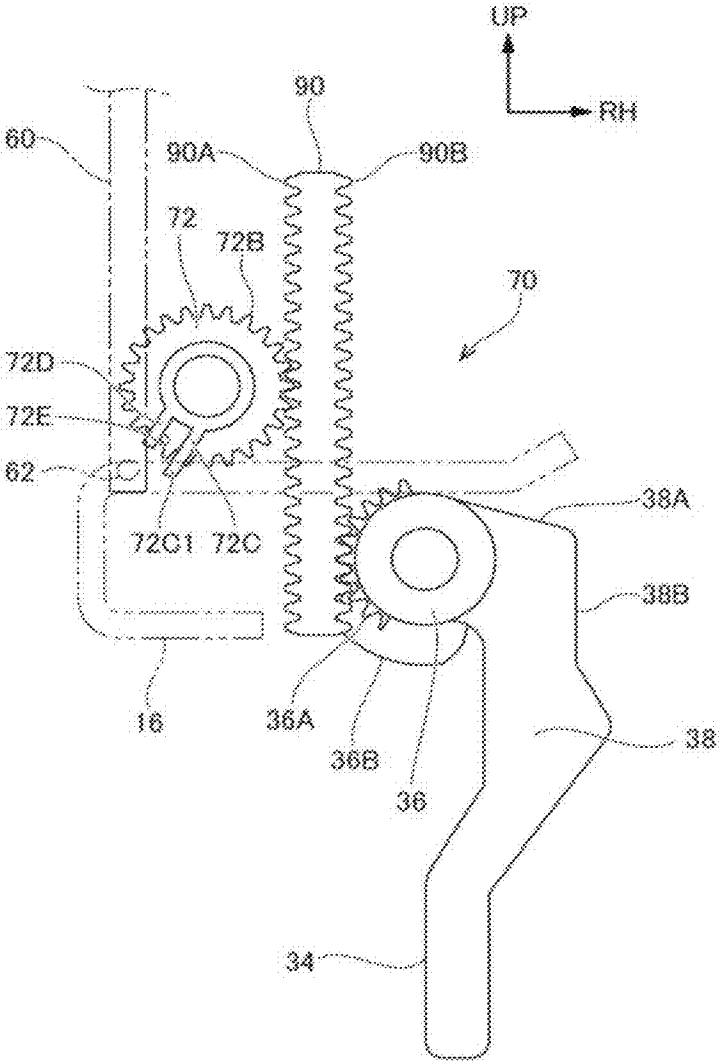
FIGS. 6A and 6B are explanatory diagrams for explaining a modification of the lever interlocking mechanism shown in FIG. 2, and specifically.

Next, description will be made with reference to FIGS. 6A and 6B regarding a modification of the lever linkage mechanism 70.

In a modification of the lever interlocking mechanism 70, the second gear 74 and the third gear 76 are omitted. Instead of the second gear 74 and the third gear 76, a rack 90 is provided. The rack 90 is configured to have an approximately longitudinal plate structure with the front-rear direction as its thickness direction such that it extends in the upper-lower direction. The rack 90 is arranged between the first gear 72 and the operating lever 34. Furthermore, the rack 90 is supported by the frame 14 (not shown in FIGS. 6A and 6B) such that it can be slid in the upper-lower direction.

A first rack gear portion 90A is formed on the left-side face of the rack 90. The first rack gear portion 90A is configured as multiple rack teeth, and is arranged such that it meshes with the first gear portion 72B of the first gear 72. Furthermore, a second rack gear portion 90B is formed on the right-side face of the rack 90. The second rack gear portion 90B is configured as multiple rack teeth. The second rack gear portion 90B is arranged such that it meshes with the lever-side gear portion 36A of the operating gear 36A.

It should be noted that, in a case of employing such a modification of the lever interlocking mechanism 70, the operating lever 34 is configured to have a larger thickness in the front-rear direction than that in the present embodiment. Furthermore, the presser bar holder 16 is configured such that it extends linearly along the left-right direction. Moreover, the first gear 72, the rack 90, and the lever-side gear portion 36A of the operating lever 34 are arranged on the rear side of the presser bar holder 16 so as not to interfere with the presser bar holder 16.

Figure 6A:
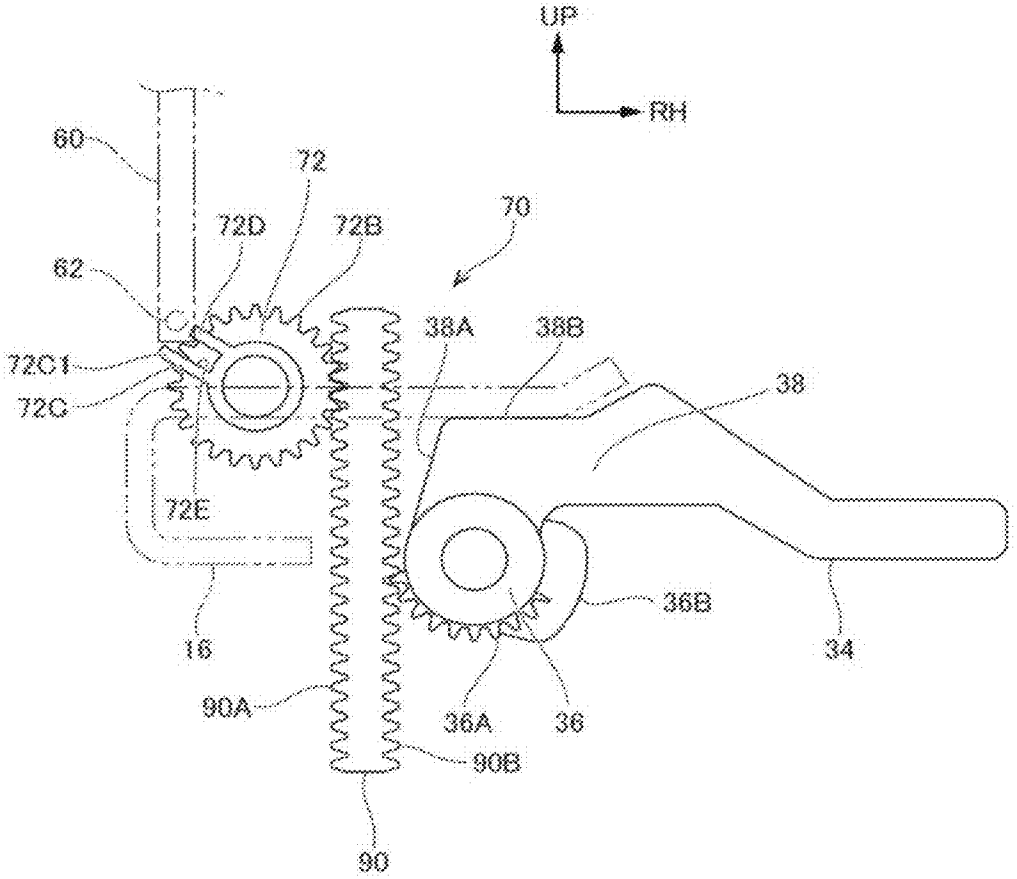

With such an arrangement, as shown in FIG. 6A, when the threading lever 56 (not shown in FIG. 6A) is set to the initial position and when the operating lever 34 is set to the operating position, the engagement portion 72C1 of the first gear 72 is arranged below the operating shaft 62 of the elevating unit 60 with a gap between them. Upon pressing the threading lever 56 downward in this state, the operating shaft 62 of the elevating unit 60 is engaged with the engagement portion 72C1 of the first gear 72, and the first gear 72 is rotated in one rotational direction. Furthermore, in this stage, the rack 90 that meshes with the first gear 72 is displaced upward, which turns the operating lever 34 that meshes with the rack 90 toward the non-operating position (see FIG. 6B). Accordingly, with such a modification of the lever interlocking mechanism 70, as with the present embodiment, this arrangement is capable of transmitting the operating force applied to the threading lever 56 to the operating lever 34 via the lever interlocking mechanism 70, thereby allowing the operating lever 34 to be turned from the operating position to the non-operating position.

It should be noted that description has been made in the present embodiment regarding an arrangement in which the first gear 72 included in the lever interlocking mechanism 70 includes the engagement wall 72D and the engagement groove 72E. Also, in the first gear 72, the engagement wall 72D and the engagement groove 72E may be omitted.

It should be noted that description has been made in the present embodiment regarding an arrangement in which the lever interlocking mechanism 70 is configured as a gear train. However, the lever interlocking mechanism 70 is not restricted to such an arrangement. For example, the lever interlocking mechanism 70 may be configured as a link mechanism such that the operating force applied to the threading lever 56 is transmitted to the operating lever 34 via the lever interlocking mechanism 70.

DESCRIPTION OF THE REFERENCE NUMERALS

10 sewing machine, 12 presser bar, 14 frame, 16 presser bar holder, 18 presser spring, 20 presser, 22 needle plate, needle bar, 26 needle bar support body, 26A support member, 28 coupling member, 30 thread hook portion, 32 needle, 32A needle hole, 34 operating lever, 36 rotation support portion, 36A lever-side gear portion (gear portion), 36B arm cam, 38 lever main body, 39A first cam face, 38B second cam face, 40 support shaft, 42 release arm, 42A support hole, 44 arm shaft, 46 arm force-applying spring, 50 threading apparatus, 52 threading shaft, 54 guide shaft, 56 threading lever, 56A knob portion, 56B support portion, 58 threading mechanism unit, 58A thread holder unit, 60 elevating unit, 62 operating shaft, 70 lever interlocking mechanism, 72 first gear (coupling gear), 72A first gear hole, 72B first gear portion, 72C engagement wall, 72C1 engagement portion, 72D engagement wall, 72E engagement groove, 74 second gear, 74A second gear hole, 74B second gear portion, 76 third gear, 76A third gear hole, 76B third gear portion, 80 first gear shaft, 82 second gear shaft, 84 third gear shaft, 90 rack, 90A first rack gear portion, 90B second rack gear portion.

What is claimed is:

1. A sewing machine comprising:

a threading apparatus comprising a threading lever configured to be operated manually, and structured such that, upon pressing the threading lever downward from an initial position, a thread is inserted into a needle hole of a needle;

an elevating unit configured to be raised and lowered together with the threading lever;

an operating lever structured such that, upon operating the operating lever from a non-operating position to an operating position, a presser is raised from a pressing position; and a lever interlocking mechanism configured to interlock with the operation of the operating lever, wherein, when the operating lever is set to the operating position, and when the elevating unit is lowered, the elevating unit is engaged with the lever interlocking mechanism, and the operating force applied to the threading lever is transmitted to the operating lever via the lever interlocking mechanism, which moves the operating lever from the operating position to the non-operating position.

2. The sewing machine according to claim 1, wherein, when the operating lever is operated, the lever interlocking mechanism is not engaged with the elevating unit when the threading lever is set to the initial position.

3. The sewing machine according to claim 1, wherein the threading apparatus comprises a threading mechanism unit configured to perform a thread insertion operation in which the thread is inserted into the needle hole, wherein, upon pressing the threading lever downward, the threading lever is lowered from the initial position to a second pressed-down position via a first pressed-down position, wherein, before the threading lever reaches the first pressed-down position, the operating lever is moved to the non-operating position by the lever interlocking mechanism when the operating lever is set to the operating position, and engagement between the lever interlocking mechanism and the elevating unit is released, and wherein, when the threading lever is lowered from the first pressed-down position to the second pressed-down position, the threading mechanism unit performs the thread insertion operation.

4. The sewing machine according to claim 1, wherein a gear portion is formed in the operating lever, and wherein the lever interlocking mechanism is configured as a gear train coupled to the gear portion.

5. The sewing machine according to claim 4, wherein an operating shaft is provided to the elevating unit, wherein the gear train comprises a coupling gear comprising an engagement portion that allows the gear train to be engaged with the operating shaft, wherein, when the threading lever is set to the initial position and the operating lever is set to the operating position, the engagement portion is arranged on a path of the operating shaft and below the operating shaft with a gap between them, and wherein, when the operating lever is set to the non-operating position, the engagement portion is arranged at a position displaced from the path of the operating shaft.

6. The sewing machine according to claim 5, wherein an engagement groove is provided to the coupling gear, and wherein, after the operating shaft is engaged with the engagement portion, the operating shaft is inserted into the engagement groove.

* * * * *